US006481430B1

(12) United States Patent
Lightcap, Jr.

(10) Patent No.: US 6,481,430 B1
(45) Date of Patent: Nov. 19, 2002

(54) BOWSTRING RELEASE DEVICE AND ITS ASSOCIATED METHOD OF OPERATION

(76) Inventor: L. Lawrence Lightcap, Jr., 509 Main St., Pennsburg, PA (US) 18073

( * ) Notice: Subject to any disclaimer, the term of this patent is extended or adjusted under 35 U.S.C. 154(b) by 0 days.

(21) Appl. No.: 09/678,882

(22) Filed: Oct. 5, 2000

(51) Int. Cl.[7] ..... F41B 5/18
(52) U.S. Cl. ..... 124/35.2
(58) Field of Search ..... 124/35.2, 40

(56) References Cited

U.S. PATENT DOCUMENTS

| | | | | | |
|---|---|---|---|---|---|
| 3,853,111 | A | * | 12/1974 | Stanislawski et al. | 124/35.2 |
| 3,965,884 | A | * | 6/1976 | Killian | 124/35.2 |
| 4,539,968 | A | | 9/1985 | Garvison | 124/35.2 |
| 4,567,875 | A | | 2/1986 | Fletcher | 124/35.2 |
| 5,025,772 | A | * | 6/1991 | Stevenson | 124/35.2 |
| 5,067,472 | A | | 11/1991 | Vogel et al. | 124/35.2 |
| 5,247,922 | A | * | 9/1993 | Lalonde | 124/35.2 |
| 5,653,213 | A | | 8/1997 | Linsmeyer | 124/35.2 |
| 5,666,936 | A | | 9/1997 | Estrada | 124/35.2 |
| 6,032,661 | A | * | 3/2000 | Goff et al. | 124/35.2 |
| 6,247,467 | B1 | * | 6/2001 | Siegfried | 124/35.2 |

* cited by examiner

*Primary Examiner*—John A. Ricci
(74) *Attorney, Agent, or Firm*—LaMorte & Associates

(57) ABSTRACT

A bowstring release device is claimed for drawing and releasing the bowstring on an archery bow. The bowstring release device includes a main body that is grasped and pulled by an archer. The main body defines a notch that is sized to receive a segment of a bowstring. The notch has an open end through which the segment of the bowstring can enter and exit. A release arm is coupled to the main body with a pivot. The release arm is selectively positionable between a closed position, where the release arm extends over the open end of the notch, and an open position, where the release arm does not obstruct the open end of the notch. A first locking mechanism is provided that engages the release arm when it is in its closed position. The first locking mechanism prevents the release arm from moving into its open position until a predetermined threshold force is applied to the release arm by the bowstring. Once the force applied to the release arm exceeds the threshold force, the release arm automatically moves to its open position and releases the bowstring. A second safety locking mechanism is provided to prevent the release arm from accidentally opening while the arrow is first being drawn.

18 Claims, 5 Drawing Sheets

BOWSTRING RELEASE DEVICE AND ITS ASSOCIATED METHOD OF OPERATION

BACKGROUND OF THE INVENTION

1. Field of the Invention

The present invention relates to release mechanisms for archery bowstrings.

2. Prior Art Description

Archery has been in existence for many thousands of years. In that vast period of time, there have been many variations to bows, arrows, bowstrings and other associated archery accessories. However, it has only been recently that the use of mechanical bowstring releases have been accepted into the sport of archery.

Traditionally, when a person shoots an arrow from a bow, the end of the arrow and the bowstring are engaged by the finger tips. Once the arrow is drawn to its full length, the arrow is released by letting go of the bowstring. As archery bows became more powerful and harder to draw, it became difficult to hold the arrow steady while smoothly holding and then releasing the bowstring with your fingers. It is for this reason that mechanical bowstring releases were developed.

Mechanical bowstring releases are mechanisms that engage the bowstring so that a person need not touch the bowstring with his/her fingers as an arrow is drawn. The mechanical bowstring release typically has some form of triggering mechanism so that a person can cause the mechanical bowstring release to release the bowstring when desired.

A common trigger mechanism for a mechanical bowstring device is a finger trigger. The finger trigger is positioned on the mechanical bowstring release so that it can be engaged with the index finger or middle finger. Such prior art release mechanisms are exemplified by U.S. Pat. No. 4,539,968 to Garvison, entitled Bowstring Release Device; and U.S. Pat. No. 5,653,213 to Linsmeyer, entitled Bowstring Release With Trigger Having Multiple Bowstring Securing Positions. A problem associated with such release mechanisms is that many people find it difficult or awkward to draw a bowstring without using their index finger or middle finger. As such, many people use these fingers to draw the bow and then change their grip to engage the trigger. The need to change the grip is awkward and often results in unsteady releases and inaccurate shots.

Another popular type of mechanical release mechanism utilizes a thumb trigger. Prior art bowstring releases that use such mechanisms are exemplified by U.S. Pat. No. 5,067,472 to Vogel, entitled Bowstring Release; and U.S. Pat. No. 3,898,974 to Keck, entitled Archery Bowstring Release. Although these release mechanisms do not require a person to change their grip, they do have other disadvantages. One of these disadvantages is that an archer must draw an arrow, pause the arrow when fully drawn and engage the release mechanism with their thumb in order to shoot the arrow. It is undesirable to pause an arrow for any significant amount of time, once the arrow is fully drawn. With powerful modern bows it is difficult to pause a fully drawn arrow without the contracted muscles in the arm causing some unsteadiness in the arrow. The longer the arrow is paused, the greater the unsteadiness typically becomes.

A need therefore exists for a new type of bowstring release mechanism that does not cause an archer to change his/her grip or pause just prior to shooting an arrow. This need is met by the present invention as it is described and claimed below.

SUMMARY OF THE INVENTION

The present invention is a bowstring release device for drawing and releasing the bowstring on an archery bow. The bowstring release device includes a main body that is grasped and pulled by an archer. The main body defines a notch that is sized to receive a segment of a bowstring. The notch has an open end through which the segment of the bowstring can enter and exit. A release arm is coupled to the main body with a pivot. The release arm is selectively positionable between a closed position, where the release arm extends over the open end of the notch, and an open position, where the release arm does not obstruct the open end of the notch.

A first locking mechanism is provided that engages the release arm when it is in its closed position. The first locking mechanism prevents the release arm from moving into its open position until a predetermined threshold force is applied to the release arm by the bowstring. Once the force applied to the release arm exceeds the threshold force, the release arm automatically moves to its open position and releases the bowstring. A second safety locking mechanism is provided to prevent the release arm from accidentally opening while the arrow is first being drawn.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
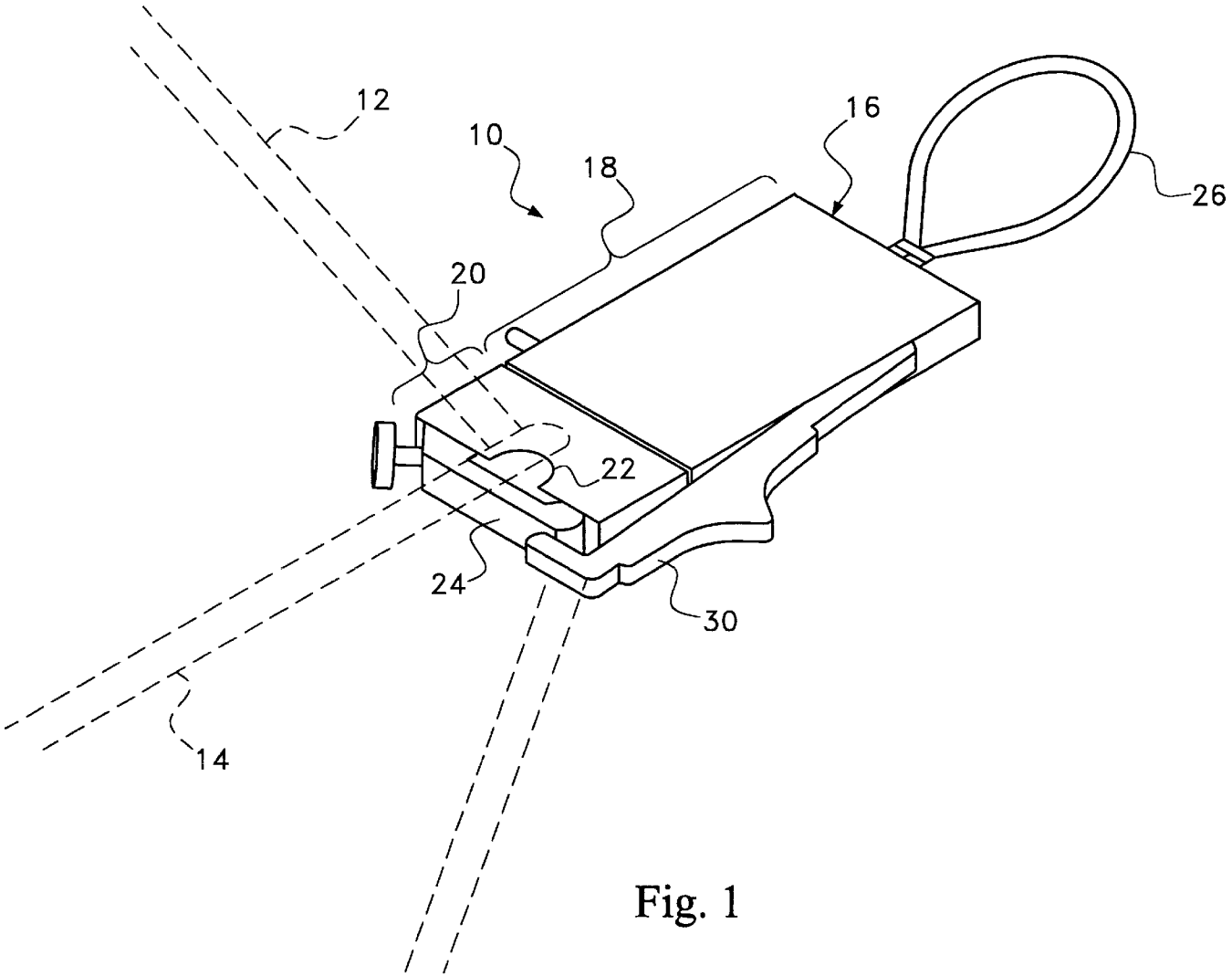
FIG. 1 is a perspective view of one preferred embodiment of the present invention bowstring release device shown in conjunction with a segment of a bowstring and an arrow.

Referring to FIG. 1, an exemplary embodiment of a bowstring release device 10 is shown. The bowstring release device 10 is attached to the bowstring 12 of an archery bow directly below where an arrow 14 engages the bowstring 12. The bowstring release device 10 is a mechanical assembly that has a main body 16. It is the main body 16 that is grasped and pulled by an archer drawing an arrow. The main body 16 is divided into two separate sections, which are the head section 20 and the base section 18. A notch 22 is provided in the head section 20 of the main body 16. A release arm 24 is positioned in front of the notch 22. The bowstring 12 is held in the notch 22 behind the release arm 24. When the bowstring 12 is being drawn, the release arm 24 stays closed. When the draw of the arrow is complete, the release arm 24 opens and releases the bowstring 12 to shoot the arrow 14. An optional wrist strap 26 is provided to prevent the bowstring release device 10 from slipping out of an archer's hand while being used to draw the bowstring 12.

The bowstring release device 10 does not have a manually activated trigger. Rather, the bowstring release device 10 is force activated. When the force of the bowstring 12 on the release arm 24 exceeds a predetermined threshold value, the release arm 24 automatically releases. Accidental release of the bowstring 12 is prevented by the use of a safety latch 30, as will later be explained.

Figure 2:
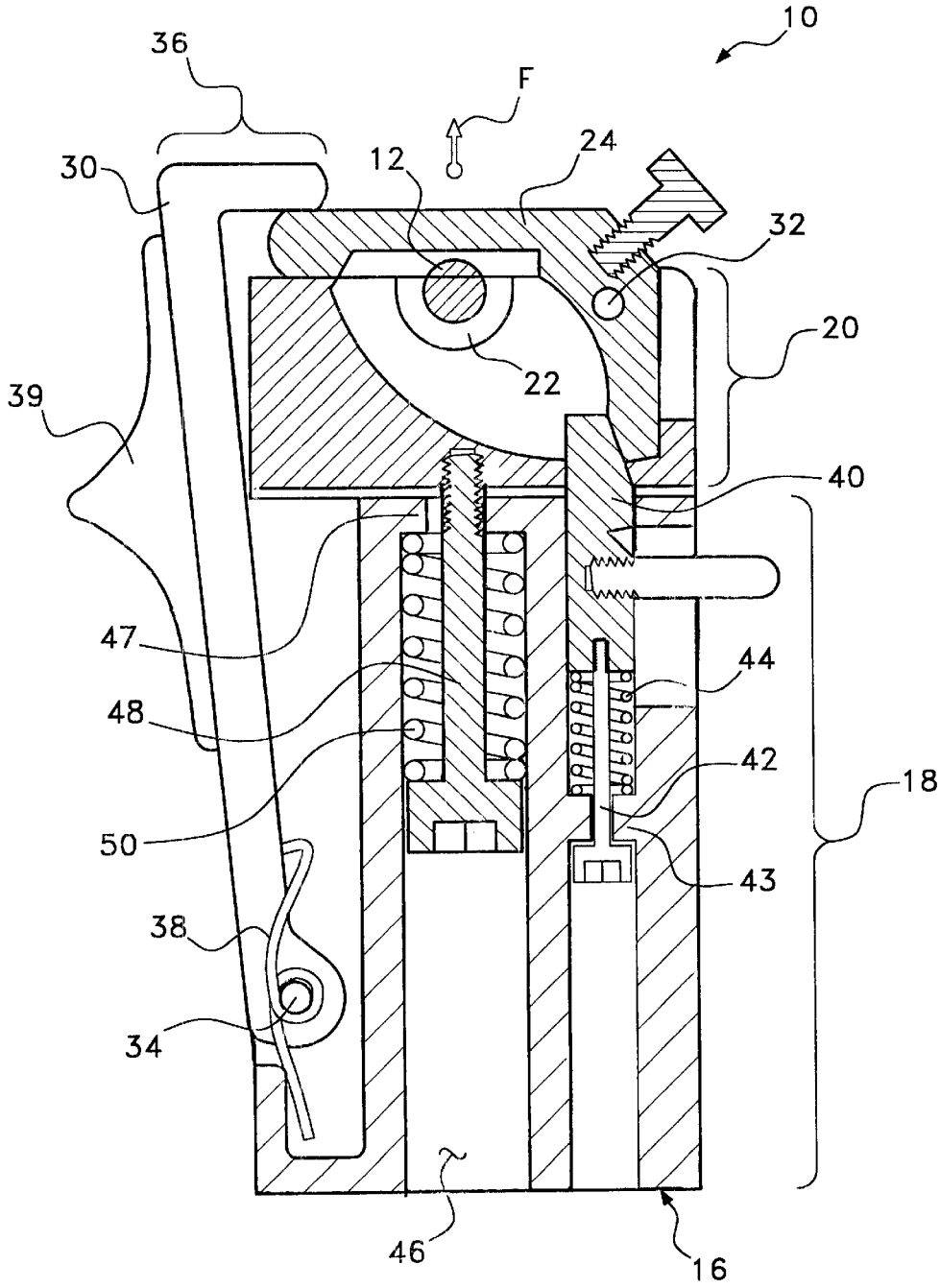
FIG. 2 is a selectively cross-sectioned view of the bowstring release device shown in a closed condition.

Referring to FIG. 2, it can be seen that the release arm 24 is a generally L-shaped component that is connected to the head section 20 of the main body 16 of the bowstring release device 10. When the bowstring 12 is placed in the notch behind the release arm 24 and the bowstring 12 is drawn, the bowstring 12 applies a force F to the release arm 24. The force F applied by the bowstring 12 acts to cause the release arm 24 to rotate about a pivot 32 in a clockwise rotation. If the release arm 24 were free to rotate about the pivot 32, the release arm 24 would swing free of the bowstring 12 and enable the bowstring 12 to escape from the notch 22.

There are two mechanisms that prevent the release arm 24 from inadvertently rotating about the pivot 32 and releasing the bowstring 12. The first mechanism is a safety latch 30. The safety latch 30 is an elongated L-shaped element that is connected to the base section 18 of the main body 16 with a pivot 34. The safety latch 30 has a foot section 36 that overlaps the release arm 24 and prevents the release arm 24 from rotating and releasing the bowstring 12. The safety latch 30 is capable of rotating about the pivot 34 into an open position where the foot section 36 of the safety latch 30 no longer contacts the release arm 24. The safety latch 30 is biased into this open position by a spring 38. Accordingly, when left alone, the safety latch 30 does not engage the release arm 24. Rather, it is only when the safety latch 30 is pressed toward the release arm 24 by a person's fingers that the safety latch 30 engages the release arm 24. To facilitate a comfortable contact point with the safety latch 30, a contoured finger hold 39 is coupled to the exterior of the safety latch 30.

The second mechanism that is used to prevent the release arm 24 from inadvertently rotating about the pivot 32 and releasing the bowstring 12 is a locking pawl 40. The locking pawl 40 abuts against one leg of the release arm 24, thereby preventing the release arm 24 from rotating around the pivot 32 and releasing the bowstring 12. The locking pawl 40 extends a predetermined distance above the base section 18 of the main body 16 of the bowstring release device 10. The distance that the locking pawl 40 extends above the base section 18 is adjustable. An adjustment screw 42 extends into the bottom of the locking pawl 40. The adjustment screw 42 extends through a support element 43 that is part of the base section 18. A spring 44 is positioned between the bottom of the locking pawl 40 and the support element 43. The spring 44 biases the locking pawl 40 away from the support element 43 as far as the adjustment screw 42 will allow. By tightening or loosening the adjustment screw 42, the distance that the locking pawl 40 extends above the base section 18 can be selectively changed.

The head section 20 and the base section 18 of the main body 16 are not rigidly attached. Rather, the head section 20 of the main body 16 is biased against the base section 18 of the main body 16 in a set orientation. An open bore 46 is formed through the base section 18 of the main body 16. The bore 46 is open at one end and defines a reducing ledge 47 at the opposite end. A large release force set screw 48 extends into the open bore 46 and past the reducing ledge 47, wherein the release force set screw 48 engages the head section 20 of the main body 16. A coil spring 50 is positioned within the bore 46 in between the head of the release force set screw 48 and the reducing ledge 47. The coil spring 50 therefore biases the head section 20 of the main body 16 against the base section 18 of the main body 16. The force biasing the head section 20 of the main body 16 against the base section 18 of the main body 16 is supplied by the coil spring 50. As such, the biasing force is a function of the spring constant of the coil spring 50 and the degree to which the coil spring 50 is compressed. As the release force set screw 48 is tightened and loosened, the degree to which the coil spring 50 is compressed is changed. Accordingly, the bias supplied by the coil spring 50 can be selectively adjusted by tightening or loosening the release force set screw 48.

Figure 3:
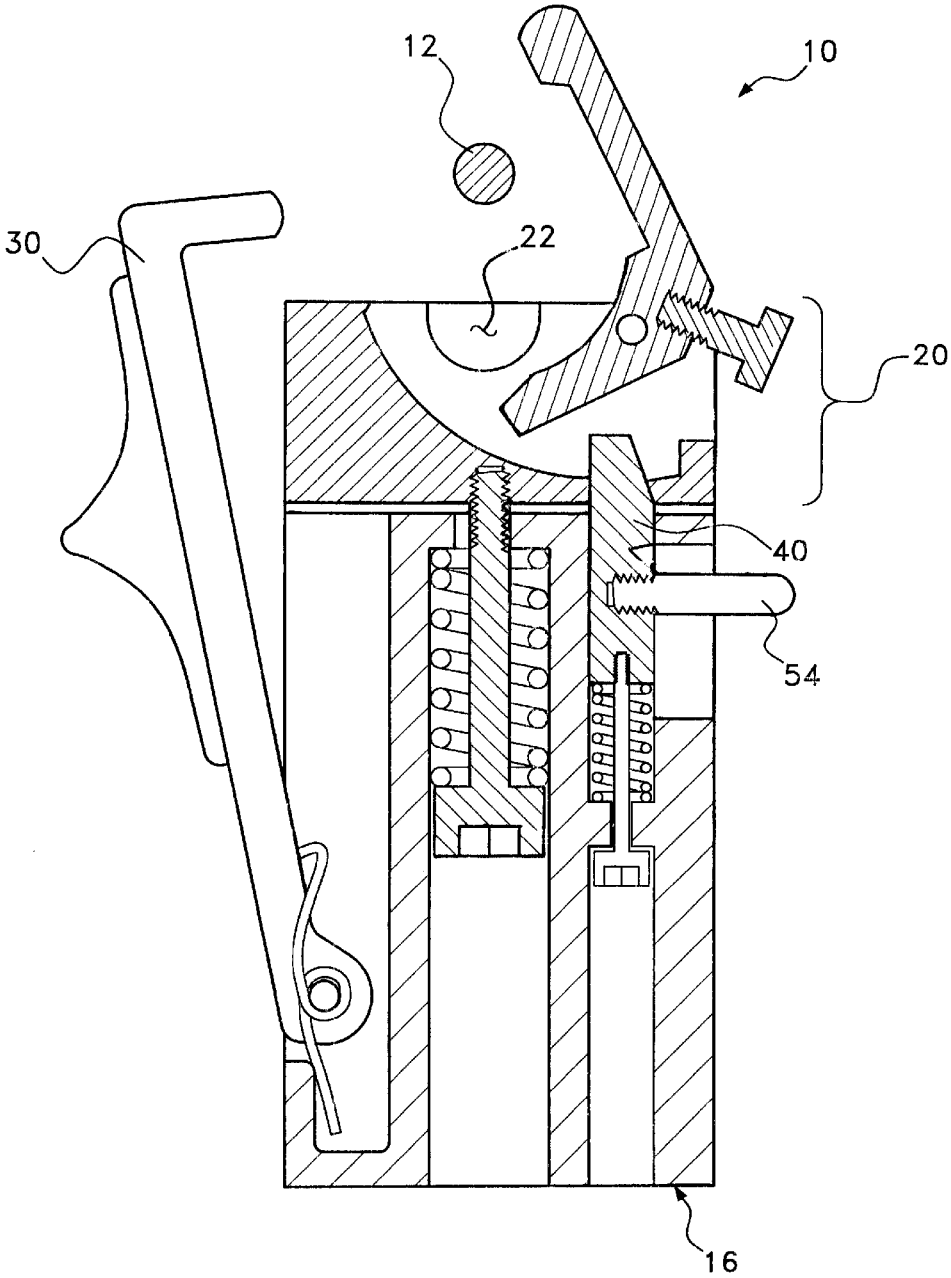
FIG. 3 is a selectively cross-sectioned view of the bowstring release device shown in an open condition.

Referring to FIG. 3. the bowstring release mechanism 10 is shown in an open condition, prior to use. To use the bowstring release mechanism 10, the release arm 24 is rotated to the open position. When not touched by an archer's fingers, the safety latch 30 does not engage the release arm 24. As such, the safety latch 30 does not prevent the release arm 24 from rotating into an open position. The only resistance to the rotation of the release arm 24 is provided by the locking pawl 40. To temporarily move the locking pawl 40 out of the way, a loading pin 54 that extends from the locking pawl 40 is pulled downward. As the loading pin 54 is pulled downward, the locking pawl 40 moves down until the locking pawl 40 no longer engages the release arm 24. At this point, the release arm 24 is free to rotate.

To load a bowstring 12 into the bowstring release mechanism 10, the release arm 24 is rotated to its open position and the bowstring 12 is placed in the notch 22 in the head section 20 of the main body 16. Once the bowstring 12 is in place, the release arm 24 is rotated back to its closed position and the loading pin 54 is released. Once the loading pin 54 is released, the locking pawl 40 extends upwardly and engages the release arm 24, thereby retaining the release arm 24 in the closed position.

Returning to FIG. 2, it can be seen that once the bowstring 12 is in place, the safety latch 30 is pressed so that the safety latch 30 overlaps the release arm 24. Once in this position, an arrow can be notched onto the bowstring 12 and the bowstring 12 can be drawn. As the bowstring 12 is drawn, a large force F is applied to the release arm 24 by the bowstring 12. However, the release arm 24 is prevented from moving by both the safety latch 30 and the locking pawl 40.

With a modern compound archery bow, the force required to draw the bowstring 12 decreases as the bowstring 12 approaches its fully drawn position. The reduction in pull force is created by the pulley configurations at either end of the bowstring 12. Once an archer has drawn an arrow on the bowstring 12 and has taken aim with the arrow. The manual force applied to the safety latch 30 is released.

Figure 4:
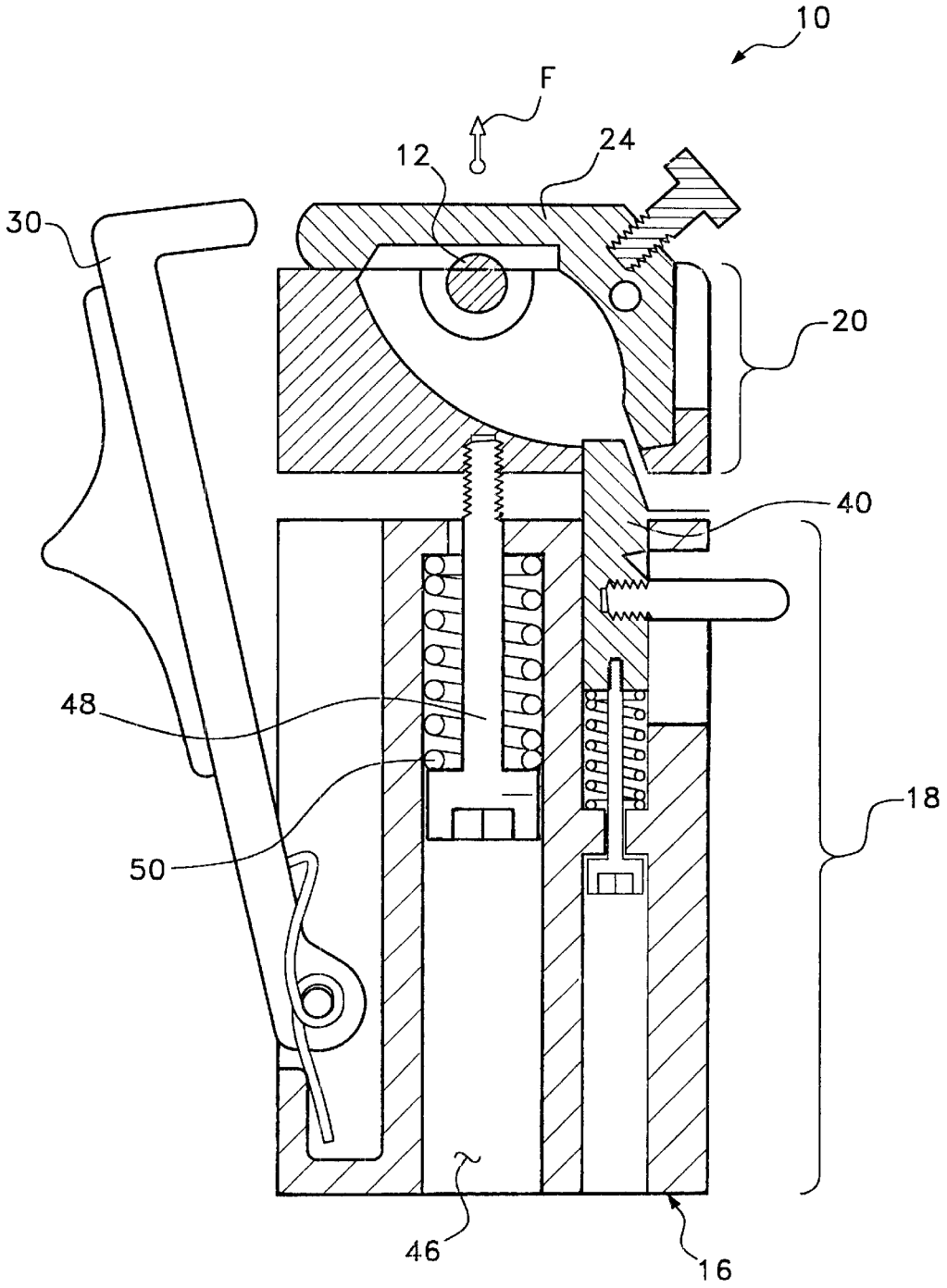
FIG. 4 is a selectively cross-sectioned view of the bowstring release device shown while approaching a firing condition.

Referring to FIG. 4, it can be seen that once the safety latch 30 is released, the only mechanism that prevents the release arm 24 from opening is the abutment of the locking pawl 40 against the release arm 24. However, once the safety latch 30 is released, the force F applied by the bowstring 12 acts to pull the head section 20 of the main body 16 away from the base section 18 of the main body 16. This movement is resisted by the coil spring 50 positioned around the release force set screw 48.

As an archer continues to draw an arrow to its fully drawn length, the force F applied to the release arm by the bowstring 12 again begins to increase. At some point during the drawing of the arrow, the force F applied by the bowstring 12 surpasses the bias of the coil spring 50 around the release force set screw 48 and the top section 20 of the main body 16 lifts away from the bottom section 18 of the main body 16 by a critical distance.

Figure 5:
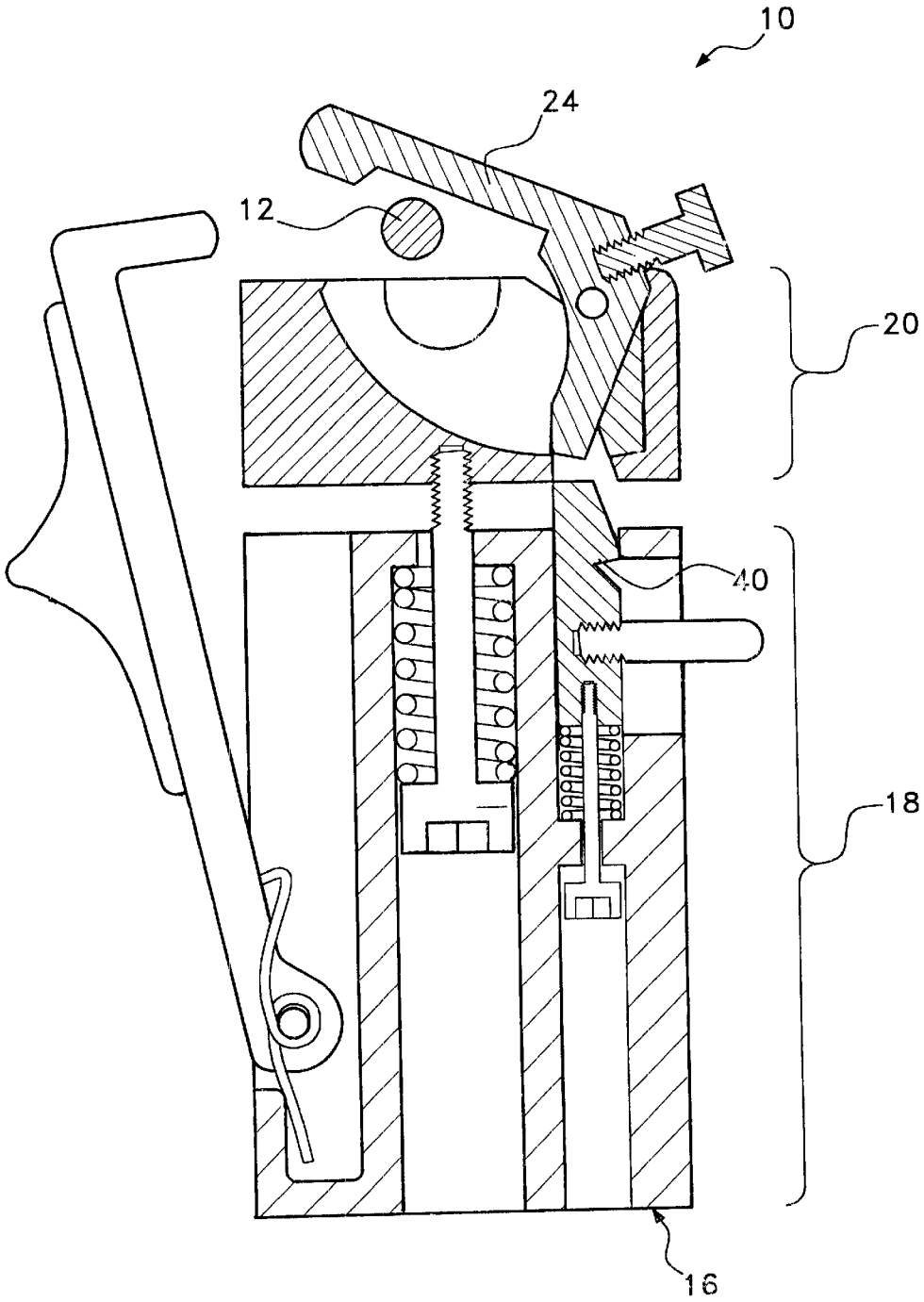
FIG. 5 is a selectively cross-sectioned view of a bowstring release device shown while experiencing a firing condition.

Referring to FIG. 5, it can be seen that as the head section 20 of the main body 16 lifts away from the base section 18 of the main body 16, the area of abutment between the release arm 24 and the locking pawl 40 decreases. Eventually, the release arm 24 is no longer restricted by the locking pawl 40 and the release arm 24 rotates rapidly to its open position. As the release arm 24 rotates to its open position, the bowstring 12 is released and the drawn arrow is fired.

Since the opening of the release arm 24 is based upon the force of the bowstring 12, the archer does not pause to fire the bowstring release mechanism 10. Rather, the bowstring release mechanism 10 fires automatically as the bowstring 12 is pulled towards its fully drawn position. An archer therefore can draw and fire an arrow with one smooth motion hat has no pauses.

It will be understood that the embodiments described herein are merely exemplary and that a person skilled in the art may make many variations and modifications to the described embodiments utilizing functionally equivalent components to those described. All such variations and modifications are intended to be included within the scope of this invention as defined by the appended claims.

What is claimed is:

1. A bowstring release device, comprising:

a body defining a notch sized to receive a segment of a bowstring therein, wherein said notch has an open end through which the segment of the bowstring can enter and exit;

a release arm coupled to said body with a pivot, said release arm being selectively positionable between a closed position, where said release arm extends over said open end of said notch, and an open position, where said release arm does not obstruct said open end of said notch;

a first locking mechanism that engages said release arm when in said closed position and prevents said release arm from moving into said open position until a predetermined threshold force is applied to said release arm by the bowstring.

2. The device according to claim 1, further including a second locking mechanism that is manually positionable between a locked position and a released position, wherein when in said locked position said second locking mechanism locks said release arm in said closed position and when in said released position, said second locking mechanism does not engage said release arm.

3. The device according to claim 2, further including a spring for biasing said second locking mechanism into said released position.

4. The device according to claim 2, wherein said second locking mechanism includes a locking pawl that contacts said release arm and prevents said release arm from rotating about said pivot from said closed position to said open position.

5. The device according to claim 4, wherein said body includes a head section and a base section that are biased against one another by a spring.

6. The device according to claim 5, wherein said release arm is coupled to said head section of said body and said locking pawl is coupled to said base section of said body.

7. The device according to claim 6, wherein said head section of said body and said base section of said body separate to a point where said release arm and said locking pawl no longer contact when said predetermined threshold force is applied to said release arm by the bowstring, thereby enabling said release arm to rotate into said open position.

8. The device according to claim 2, wherein said second locking mechanism is a safety latch that at least partially overlaps said release arm when said release arm is in said closed position and said safety latch is in said locked position.

9. The device according to claim 1, further including a mechanism for selectively adjusting said predetermined threshold force.

10. The device according to claim 1, further including a wrist strap coupled to said body.

11. A device for pulling and releasing a bowstring of an archery bow, comprising:

a body capable of being manually held and pulled;

a release arm pivotably coupled to said body, wherein said release arm is selectively positionable between a closed position, wherein said release arm is capable of engaging the bowstring, and an open position, wherein said release arm releases the bowstring;

a triggering mechanism contained in said body for enabling said release arm to move from said closed position to said open position only when a force in excess of a predetermined threshold force is applied to said release arm by the bowstring.

12. The device according to claim 11, further including a safety latch for selectively engaging said release arm and preventing said release arm from moving from said closed position to said open position even if a force in excess of a predetermined threshold force is applied to said release arm by the bowstring.

13. The device according to claim 11, wherein said triggering mechanism includes a locking pawl that contacts said release arm and prevents said release arm from rotating from said closed position to said open position.

14. The device according to claim 13, wherein said body includes a head section and a base section that are biased against each other by a spring.

15. The device according to claim 14, wherein said release arm is coupled to said head section of said body and said locking pawl is coupled to said base section of said body.

16. The device according to claim 15, wherein said head section of said body and said base section of said body separate to a point where said release arm and said locking pawl no longer contact when a force in excess of said predetermined threshold force is applied to said release arm by the bowstring, thereby enabling said release arm to rotate into said open position.

17. A method of drawing and shooting an arrow from the bowstring of an archery bow, said method including the steps of:

providing a bowstring release device capable of engaging the bowstring of a bow, wherein said bowstring release device automatically releases the bowstring when the bowstring applies a force to said bowstring release device in excess of a predetermined threshold;

coupling said bowstring release device to a bowstring;

disabling said bowstring release device so that it cannot release the bowstring;

drawing an arrow on the bowstring by pulling on said bowstring release device;

enabling said bowstring release device once the arrow is drawn; and continuing to draw the arrow until the bowstring applies a force in excess of said predetermined threshold and said bowstring release device releases the bowstring and fires the arrow.

18. The method according to claim 17, wherein said bowstring release device includes a release arm that engages the bowstring, and said step of disabling said bowstring release device includes engaging said release arm with a safety latch.

* * * * *